United States Patent [19]

Washimine

[11] 4,002,118

[45] Jan. 11, 1977

[54] PRINTER MECHANISM FOR ADJUSTING THE POSITION OF HAMMERS

[75] Inventor: Osamu Washimine, Sayama, Japan

[73] Assignee: Citizen Watch Co., Ltd., Tokyo, Japan

[22] Filed: Sept. 23, 1975

[21] Appl. No.: 616,134

[30] Foreign Application Priority Data

Sept. 27, 1974 Japan ..... 49-111089

[52] U.S. Cl. ..... 101/93.14; 101/93.03; 101/111

[51] Int. Cl.[2] ..... B41J 1/20

[58] Field of Search ..... 101/111, 93.14, 93.03, 101/93.28–93.36, 93.09, 269

[56] References Cited

UNITED STATES PATENTS

| | | | |
|---|---|---|---|
| 3,280,738 | 10/1966 | Goodrich | 101/269 |
| 3,442,210 | 5/1969 | Hawxhurst | 101/93.14 X |
| 3,623,427 | 11/1971 | Buehrmann et al. | 101/111 X |
| 3,730,082 | 5/1973 | Perry | 101/93.14 |
| 3,780,648 | 12/1973 | Curtiss et al. | 101/93.14 X |
| 3,797,387 | 3/1974 | Decker et al. | 101/93.09 |

*Primary Examiner*—Edward M. Coven
*Attorney, Agent, or Firm*—Sherman & Shalloway

[57] ABSTRACT

A printer mechanism is provided for adjusting the position of hammers when the relative distance between a type character and a print hammer is changed. The mechanism comprises a plurality of hammers driven toward a series of type characters which are continuously carried along the printing line to print characters on a record sheet interposed between said print hammers and type characters. The mechanism is designed such that said print hammers are shifted in the printing line so that the positions of respective hammers may be adjusted and correct printing is accomplished.

2 Claims, 7 Drawing Figures

PRINTER MECHANISM FOR ADJUSTING THE POSITION OF HAMMERS

BACKGROUND OF THE INVENTION

1. Field of the Invention

This invention relates to a hammer type printer, and more particularly to a mechanism for shifting a plurality of print hammers along a printing line so as to adjust a print timing and thereby adjust the positions of the print hammers.

In printers known as type printers wherein a print hammer is driven toward type characters on a print belt continuously carried along a printing line, the adjustment of positions of the print hammers is required every time a recording sheet is changed to a sheet of different thickness. The reason is that if another record sheet, different in thickness, is exchanged without adjustment of the print hammer positions, flying time is varied whereby the relation of the positions between each of print hammers and each of type characters on the print belt is changed.

2. Description of the Prior Art

Heretofore, when record sheets of different thickness are exchanged, the adjustment of the print hammers positions has been effected by advancing or retracting the print hammers toward or from the type characters.

However conventional mechanisms for adjusting the positions of print hammers have defects that are troublesome to adjust because both right and left side ends of print hammer support members should be adjusted by shifting them in equal distance. There is a possibility that the adjustment of one end may be forgotten.

OBJECTS OF THE INVENTION

An object of the invention is to eliminate the disadvantages of conventional mechanism by providing a mechanism for adjusting the positions of print hammers, which is itself easy to be adjusted.

Another object of the invention is to provide a mechanism for adjusting the positions of hammers which is simple in construction and low in cost.

A further object of the invention is to provide a mechanism for adjusting the angle of the hammers so as to make the front end surfaces of respective hammers parallel to those of the type characters when both surfaces become unparallel.

Additional objects of the invention will be apparent from the following descriptions which are to be read in conjunction with the accompanying drawings.

DETAILED DESCRIPTION OF PREFERRED EMBODIMENTS

Figures 1, 6:
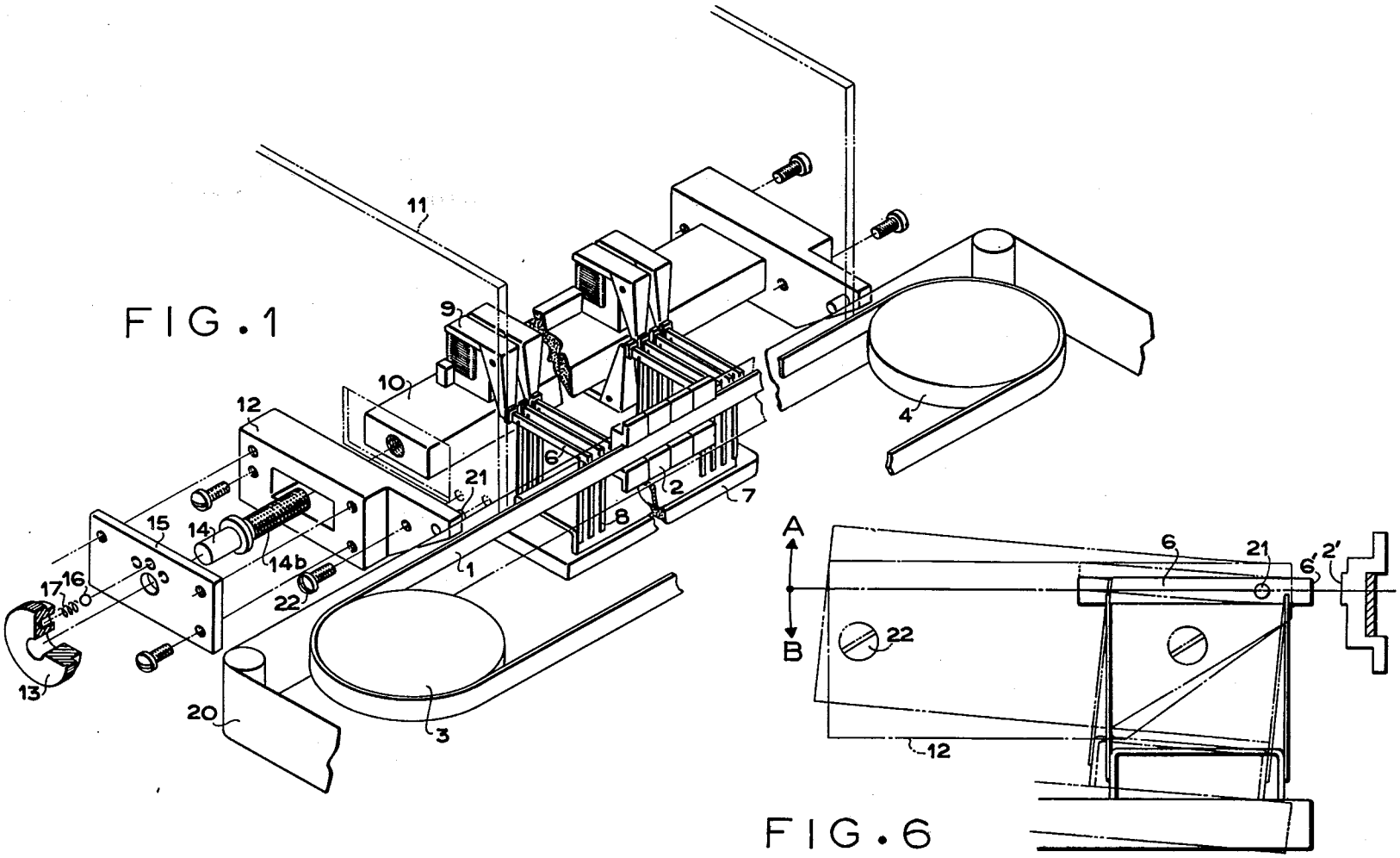
FIG. 1 is a perspective view of one embodiment of a printer mechanism according to this invention.
FIG. 6 shows a side view of a mechanism for making a surface of a type character and the front surface of a hammer parallel.
Figure 3:
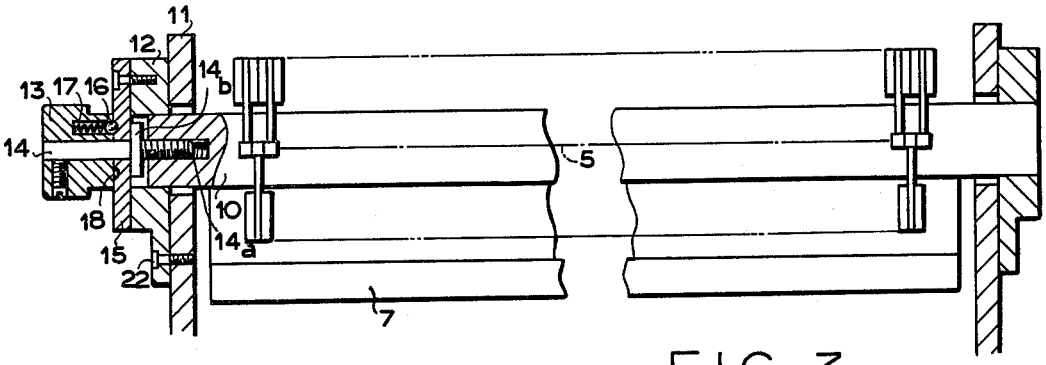
FIG. 3 is a sectional view along the A—A line of FIG. 2.
Figure 4:
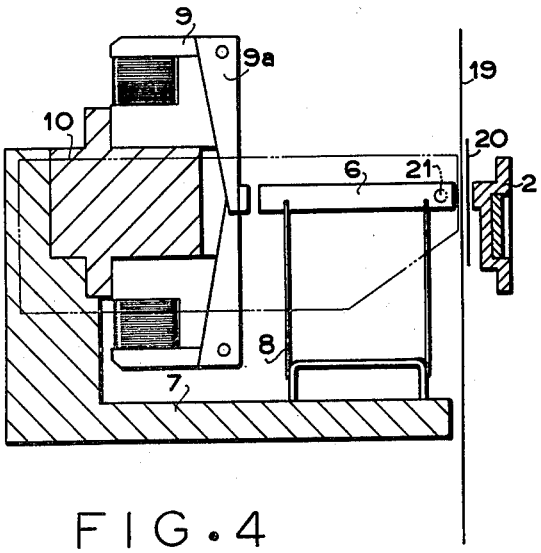
FIG. 4 is a sectional view along the B—B line of FIG. 2.

Referring to FIG. 1, the reference numeral 1 denotes a type belt on which a number of embossed type characters are formed. The type belt is wound about a driving pulley 3 and a driven pulley 4. The type belt 1 shifts a row of type characters along a printing line 5 as shown in FIG. 3. The reference numeral 6 designates a multiplicity of juxtaposed print hammers disposed on a print hammer support 7 through a leaf spring 8 as shown in FIG. 4.

The reference numeral 9 illustrates a plurality of electromagnetic means confronting the associated print hammers 6 and secured to an electromagnetic means support 10 respectively. The print hammer support 7 is loosely fitted to hole in a guide member 12 secured to a side plates 11 at the both right and left ends thereof so that the support 7 can be shifted along the printing line 5.

The reference numeral 13 depicts a dial to which an adjusting rod 14 is secured by set screw. The rod 14 is provided at its end with a screw portion 14*a* which is screwed to the electromagnetic means support 10 and at the central portion with a hub 14*b*. The dial 13 is attached to a dial fitting plate 15 positioned between the hub 14*b* and the dial. The dial 13 is not capable of moving in the axial direction of the adjusting rod 14 because the dial fitting plate 15 is screwed to the guide member 12.

The reference numeral 16 indicates a ball and 17 is a coil spring which are enclosed in a blind hole in the dial 13 and forms a detent mechanism with a number of blind holes 18 in the plate 16. Therefore the position of the dial 13 can be determined for every rotation of minute angle of the dial 13.

Figure 2:
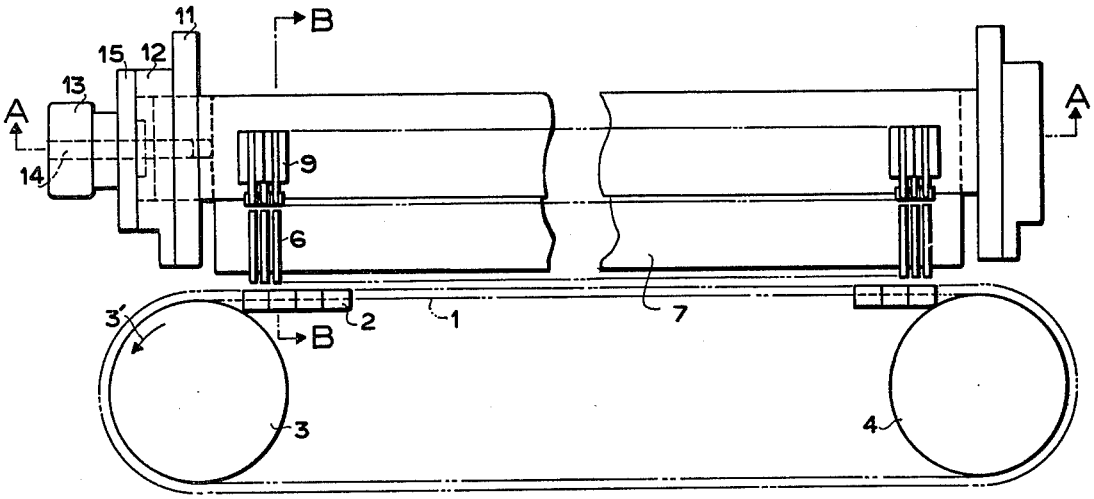
FIG. 2 is schematic plan view of a printer mechanism showing one embodiment of this invention.

In operation, the print belt 1 is fed in accordance with the rotating direction of the driving pulley 3 as shown by an arrow 3′ in FIG. 2 and the type characters pass through each character station in succession. During this operation, a type character position detecting device (not shown) detects which printing digit position the characters are aligned with. When the type character to be printed aligns with the predetermined printing digit position, the electromagnetic means operates causing the print hammer 6 which is driven through an armature 9*a* to impact to the type character 2 with a sandwiched record sheet 19 and ink ribbon 20 (shown in FIG. 4) thereby printing characters on the record sheet 19 in succession. When the predetermined characters are printed on one line of the record sheet 19, the record sheet 19 is advanced to another line and the same printing step is effected for the next line.

When the record sheet is changed to a thicker sheet as when one piece of sheet is changed to a plurality of sheets the following considerations develope.

Figure 5:
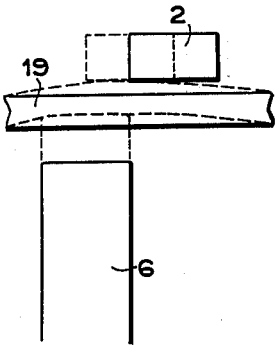
FIGS. 5A and 5B are partially plan view showing the relation of the positions between type characters and print hammers.
Figure 5:
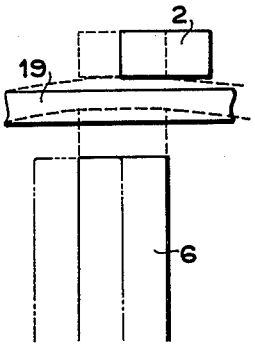

FIG. 5A is an explanatory diagram showing the situation in which one piece of record sheet is replaced by a plurality of sheets. When the type character reaches to the place indicated by are actual line, the print hammer is driven so as to separate from the place indicated by an actual line and to move toward the record sheet. The hammer 6 prints a character to be printed at the place shown by dotted lines when the type character 2 reaches the place shown by the dotted line because the thickness of the record sheet has been increased by the change.

However, as clearly shows in FIG. 5A, there is deviation of the positions between the type character 2 and the print hammer and thereby correct printing can not be effected. Therefore, when a record sheet is exchanged for another sheet or sheets different thicknesses, the dial 13 is rotated as shown in FIG. 3. Rotation of the dial shifts the electromagnetic support means in the printing direction or rather parallel with the direction of the printing line.

The print hammer support 7 is shifted so that the print hammer 6 is shifted from the position indicated by the chain line to that of the solid line, as shown in FIG. 5B. Therefore upon printing, the positions of the type character 2, shown by a dotted line, and print hammer 6, shown by a dotted line, are in accord with each other so that correct printing may be effected.

The arrangement of shifting the print hammer by the rotation of the adjusting dial 13 is not limited to situations in which printing is performed after record sheets different in thickness are exchanged. When printing is done on record sheets equal in thickness, a printer mechanism of this invention is also useful when temperature changes in the printer mechanism after long usage causes changes of electromagnetic force of the electromagnetic device 9.

FIG. 6 shows an adjusting part to make the surfaces of a type character 2′ and a front of a hammer 6′ end parallel.

A guide member 12 is secured to a side plate by means of a screw 22. A pin 21 is inserted through a hole in the front end of the guide member 12, and into the side plate 11. In order to parallel the impacting surface of the print hammer 6′ and the surface of the type character 2′, the screw 22 is loosened and the guide member is pivoted about the axis of the pin 21 thereby inclining the impacting surface of the hammer by the same rotational angle. As a result, the surface of the type character 2′ and the impacting surface of the hammer are paralleled with one another.

As clearly understood from the above discussion, when record sheets of different thickness are exchanged or when temperature in a printer changes, the deviation of position between the print hammer and type character is caused. In these situations the printer of this invention can be adjusted only by shifting it in the printing direction, i.e., adjusting one part so that parallelism of the print hammer and the print belt can be maintained. This adjustment is very easy and the struction for accomplishing the adjustment is simple.

What is claimed is:

1. A hammer type printer mechanism comprising:
- a belt having a multiplicity of embossed type characters thereon;
- a driving pulley and driven pulley around which the belt is looped to carry the characters along a printing line;
- a plurality of printing hammers for impacting with the type characters to print the characters on a recording medium;
- leaf springs for supporting said printing hammers;
- electromagnetic actuating means for striking said printing hammers to cause said printing hammers to impact against said recording medium;
- support means for mounting said leaf springs in said printer;
- means for shifting said support means in a direction parallel with the printing line, wherein said shifting means includes:
- a guide member for supporting slidably said support means;
- a threaded member journaled in said guide member and threaded in said support means so as to shift said support means when rotated, and
- a dial attached to said threaded member and exposed on one side of said guide member for manual manipulation.

2. The hammer type printer mechanism of claim 1, wherein the dial and guide member are connected by a detent mechanism which holds the dial in one of a plurality of rotary positions, and wherein the detent mechanism includes a hole in said dial containing a coil spring and ball and the guide member includes a plurality of relatively shallow holes which receive a portion of the ball therein, when the dial is rotated to align the holes in the dial with the holes in the guide member.

* * * * *